US006052959A

United States Patent [19]

LaBrosse

[11] Patent Number: 6,052,959

[45] Date of Patent: Apr. 25, 2000

[54] MOISTURE VENT

[76] Inventor: Paul A. LaBrosse, 10045 Piney Ridge Walk, Alpharetta, Ga. 30022

[21] Appl. No.: 09/040,597

[22] Filed: Mar. 18, 1998

[51] Int. Cl.[7] ..... E04D 13/064; E04B 1/70

[52] U.S. Cl. ..... 52/302.6; 52/169.5; 52/302.1; 52/302.3; 52/198; 52/101; 52/97; 52/732.1; 454/287; 248/48.1; 248/48.2

[58] Field of Search ..... 52/12, 169.5, 302.1, 52/302.3, 302.6, 198, 101, 97, 732.1; 454/287; 248/48.1, 48.2

[56] References Cited

U.S. PATENT DOCUMENTS

| | | | |
|---|---|---|---|
| 1,695,810 | 12/1928 | Magill | 52/302.1 |
| 2,350,771 | 6/1944 | Klunder | 52/302.3 |
| 2,565,122 | 8/1951 | Cowan | 52/302.1 |
| 2,703,002 | 3/1955 | Suskind | 52/302.3 |
| 2,847,949 | 8/1958 | Pond | 52/12 |
| 4,669,371 | 6/1987 | Sarazen, Jr. et al. | 454/276 |
| 5,383,310 | 1/1995 | Sapia | 52/12 |
| 5,444,947 | 8/1995 | Miller | 52/100 |
| 5,471,798 | 12/1995 | Kuhns | 52/12 |
| 5,911,659 | 6/1999 | Serano | 52/12 |

*Primary Examiner*—Carl D. Friedman
*Assistant Examiner*—Jennifer I. Thissell
*Attorney, Agent, or Firm*—Hinkle & Associates, P.C.

[57] ABSTRACT

A moisture vent (10) has an elongated back flashing (12), an elongated base side (14) extending from the back flashing, an elongated vent side (18) extending upwardly from the base side, an elongated stucco side (24) extending inwardly from the vent side, a front flashing (32) extending upwardly from the stucco side adjacent the back flashing, and a termite barrier (34) extending outwardly and downwardly from the intersection of the base and the vent sides. Upon installation, the back flashing is mounted to a foundation (6) of a structure (8) with the front flashing in contact with a foam backing (2) of an exterior insulation and finishing system (4) and the stucco side adjacent a bottom face (5) of the exterior insulation and finishing system. To provide air flow, the stucco side has slots (28), and the vent side has vents (22). In one embodiment the slots have fins, and in another embodiment, the vents have louvers. A cap (40) is provided for closing an open end (36) of the moisture vent.

6 Claims, 3 Drawing Sheets

MOISTURE VENT

BACKGROUND OF THE INVENTION

I. Field of the Invention

The present invention relates generally to the field of air flow devices. More particularly, the present invention relates to a device for releasing trapped moisture sealed within a structure by a STYROFOAM-backed exterior insulation and finishing system.

II. Description of the Related Art

An exterior insulation and finishing system (EIFF) has been developed for exterior use on structures, such as homes and offices, to give a stucco-like appearance. Generally, the EIFF comprises a foam backing, such as STYROFOAM, and a thin layer of a stucco material, such as DRYVIT, disposed on the foam backing. Although initially it was believed that the EIFF was termite resistant, experience has proven otherwise. Common installation practice of the EIFF has been to place the EIFF onto the structure at or below grade. The problem arises as a result of the foam backing material being air tight and forming a moisture barrier. Because moisture trapped within the structure can not escape through the EIFF, the moisture condenses onto the backing and pools at the lower most area of the EIFF, thereby providing an ideal environment for termite activity. Since termites thrive on water and the EIFF provides access to the structure, termites are able to undetectedly attack the foam backing and enter the structure, which more often than not results in damage to wood features of the structure.

To prevent termites from entering the structure through the EIFF, a common practice is to cut or install the EIFF a predetermined distance above grade and seal the lower most portion of the backing. Although this technique prevents undetected entrance of termites into the structure through the EIFF, it does not solve the moisture problem. Moisture continues to condense on the backing, thereby exposing wooden members of the structure to water, which over a period of time results in water damage, rot and decay. Additionally, once termites reach the EIFF, they have sufficient water available to survive within the structure without reentering the ground.

SUMMARY OF THE INVENTION

In accordance with the present invention and the contemplated problems which have and continue to exist in this field, one of the objectives of this invention is to provide a moisture vent for use with exterior insulation and finishing systems.

It is another object of the present invention to provide ventilation to a structure for the prevention of an accumulation of moisture on a backing of an exterior insulation and finishing system.

Yet, it is another object of the present invention to prevent the entrance of termites into a backing of an exterior insulation and finishing system.

This invention accomplishes the above and other objectives and overcomes the disadvantages of the prior art by providing a moisture vent that is simple in design and construction, inexpensive to fabricate, and easy to use. The moisture vent has an elongated back flashing, an elongated base side extending from the back flashing, an elongated vent side extending upwardly from the base side, an elongated stucco side extending inwardly from the vent side, a front flashing extending upwardly from the stucco side adjacent the back flashing, and a termite barrier extending outwardly and downwardly from the intersection of the base and the vent sides. To some extent, air is capable of flowing between the back and front flashings. Upon installation, the back flashing is mounted to a foundation of a structure with the front flashing in contact with a backing of the exterior insulation and finishing system and the stucco side adjacent the bottom face of the exterior insulation and finishing system. To provide air flow, the stucco side has slots, and the vent side has vents. In one embodiment the slots have fins, and in another embodiment, the vents are louvered vents. Moisture escapes through the slots into a ventilation cavity, which is defined by the back flashing and the base, vent and stucco sides, and is thereafter released to the atmosphere from the ventilation cavity through the vents. A cap is provided for closing an open end of the moisture vent.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

Figure 1:
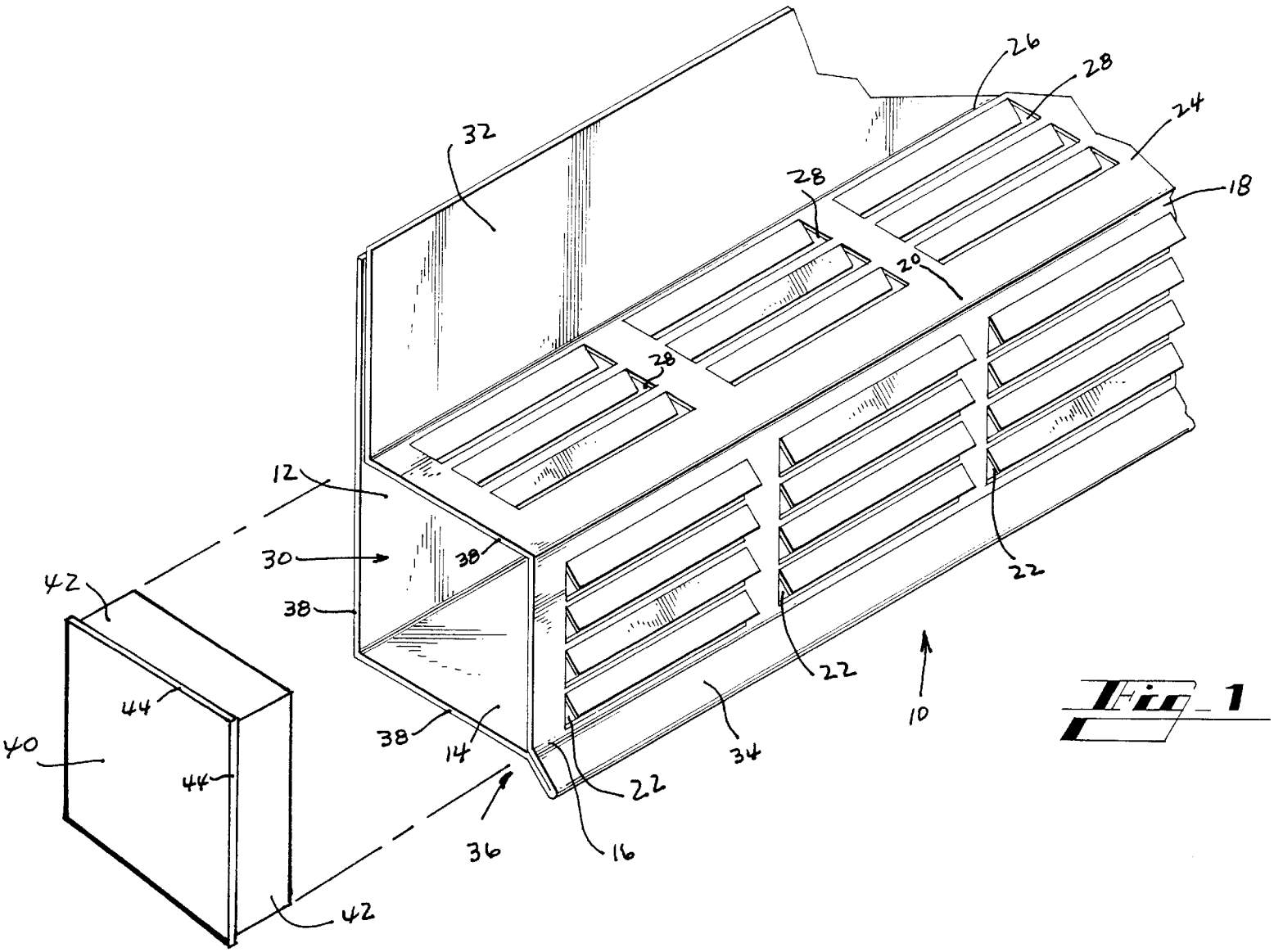
FIG. 1 is an exploded and partial perspective view of one embodiment of a moisture vent and a cap made in accordance with the present invention.

The reference numbers in the drawings relate to the following:

2=foam backing
4=exterior insulation and finishing system
5=bottom face of exterior insulation and finishing system
6=foundation
8=structure
10=moisture vent
12=back flashing
14=base side
16=lower edge
18=vent side
20=upper edge
22=vent
24=stucco side
26=back edge
28=slot

30=ventilation cavity

32=front flashing

34=termite barrier

36=end of moisture vent

38=peripheral edge

40=cap

42=insert of cap

44=lip of cap

46=louver of vent

48=fin of slot

50=mitered corner

52=seal

DESCRIPTION OF THE PREFERRED EMBODIMENTS

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a moisture vent 10 made in accordance with the present invention. The moisture vent 10 is a polygonal device that provides air flow to a foam backing 2 of an exterior insulation and finishing system 4, as shown in FIG. 2.

Figure 2:
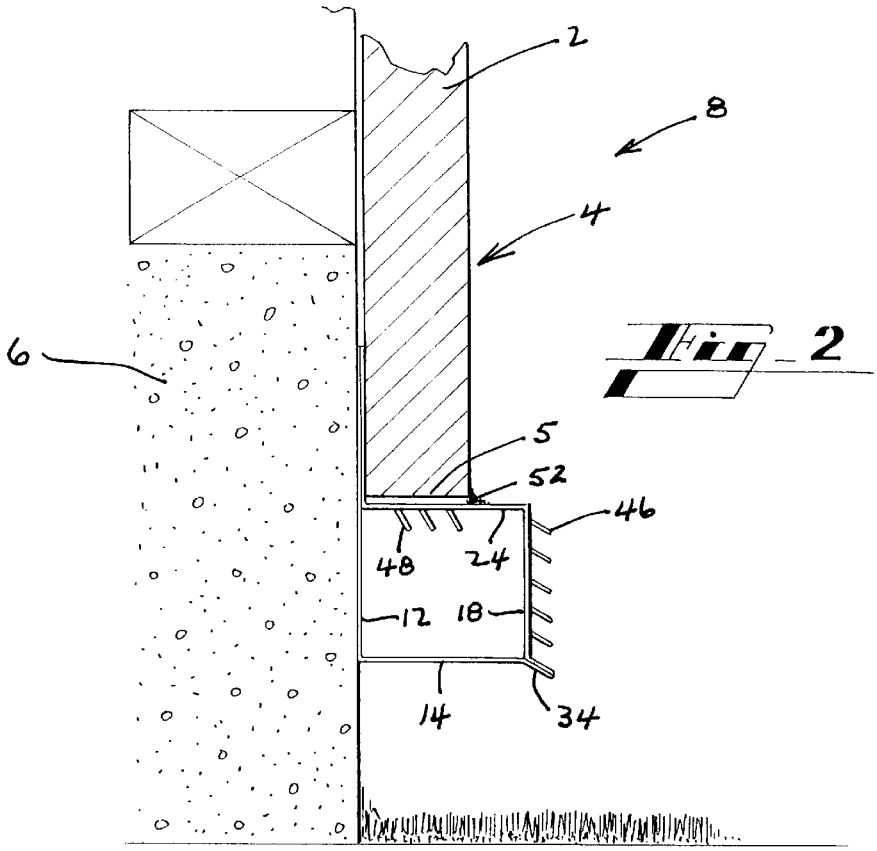
FIG. 2 is a partial, side elevation view of the moisture vent of FIG. 1 mounted to a foundation of a structure.
Figure 4:
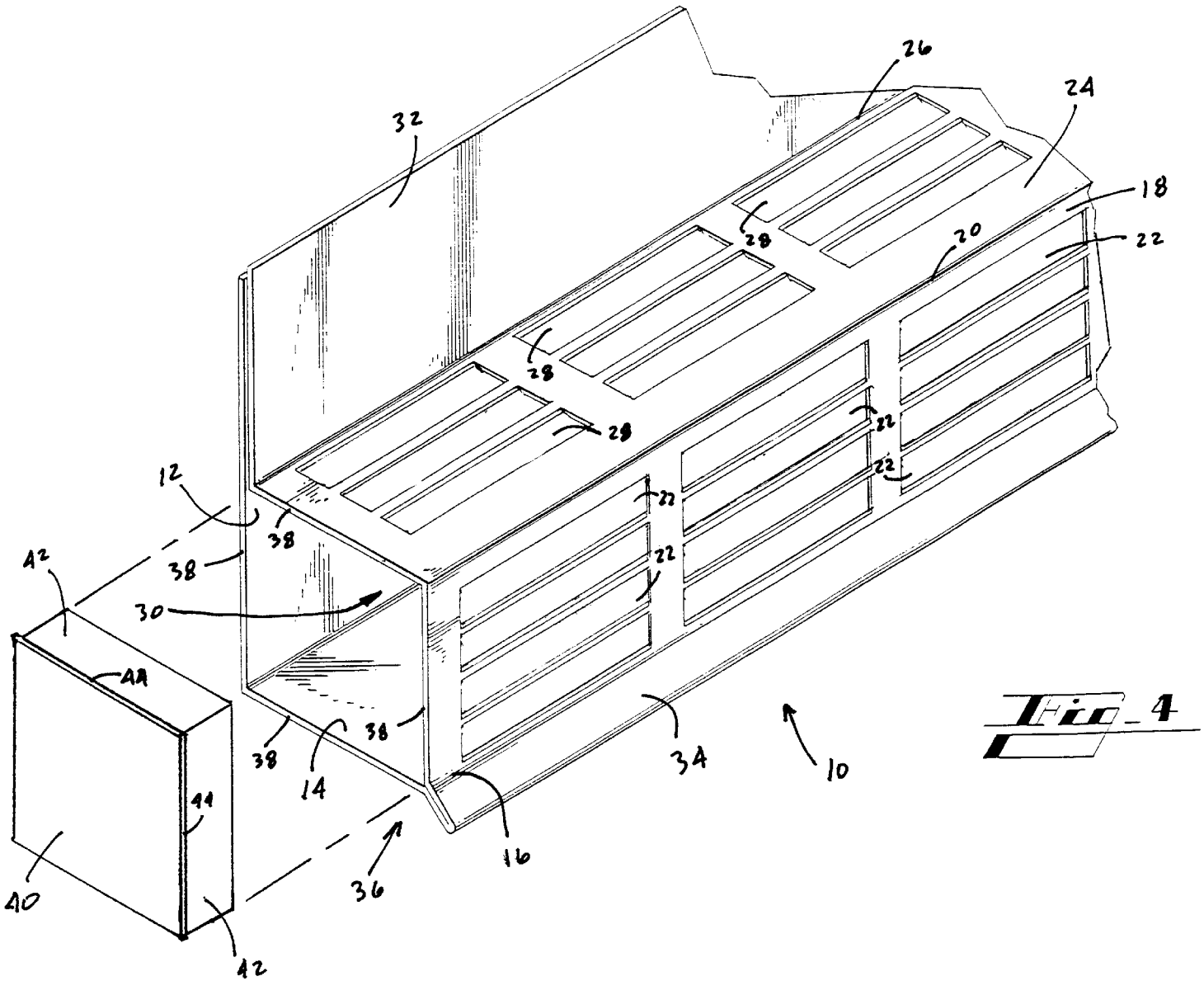
FIG. 4 is an exploded and partial perspective view of another embodiment of the moisture vent and the cap made in accordance with the present invention.

With general reference to FIGS. 1, 2 and 4, the moisture vent 10 has an elongated back flashing 12 for engaging a foundation 6 of a structure 8. Extending outwardly from the back flashing 12 is an elongated base side 14 that terminates at a lower edge 16. Preferably, the base side 14 is substantially continuous, thereby denying termites an entrance through the base side 14. An elongated vent side 18 extends upwardly from the base side 14 proximate the lower edge 16 and terminates at an upper edge 20. Vents 22 are disposed along the vent side 18. Extending inwardly from the vent side 18 proximate the upper edge 20 is an elongated stucco side 24 which terminates at a back edge 26. Slots 28 are disposed along the stucco side 24. A ventilation cavity 30 is defined by the back flashing 12 and the base, vent and stucco sides 14, 18 and 24. Extending upwardly from the stucco side 14 proximate the back edge 26 is an elongated front flashing 32 that rests adjacent the back flashing 12. Preferably, the back flashing 12 and the front flashing 32 remain unattached to one another, thereby enabling some air flow therebetween. To prevent termites from entering the ventilation cavity 30, the moisture vent 10 has a termite barrier 34 extending outwardly and downwardly from the base side 14 proximate the lower edge 16.

At an end 36 of the moisture vent 10, the back flashing 12 and the base, vent and stucco sides 14, 18 and 24 define a peripheral edge 38. To close the end 36 and secure the ventilation cavity 30, the moisture vent 10 has a cap. The cap 40 has an insert 42 which removably engages the back flashing 12 and the base, vent and stucco sides 14, 18 and 24 within the ventilation cavity 30. Although not required, the cap 40 has a lip 44 which removably engages the peripheral edge 38.

Now, referring to the embodiment of the moisture vent shown in FIG. 1, the vents 22 have louvers 46 which extend outwardly with respect to the vent side 18. The louvers 46 assist in preventing environmental water, such as rain, from entering the ventilation cavity 30. Also, the slots have fins 48 extending into the ventilation cavity 30.

In the embodiment shown in FIG. 4, the moisture vent 10 does not have the louvers 46 or fins 48. Preferably, the vents 22 are elongated and narrow, for example the width is between one-eight inch and one-quarter inch, to provide ventilation, but resist environmental water from entering the ventilation cavity 30 therethrough.

Figure 3:
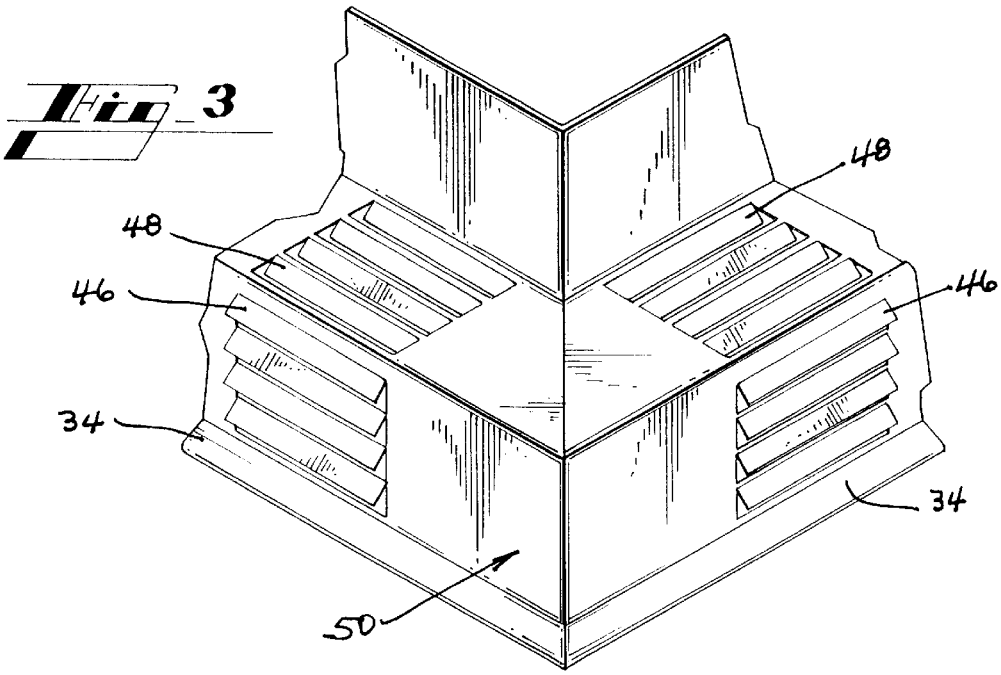
FIG. 3 is a partial perspective view of the moisture vent having a mitered joint.

With reference to FIGS. 2 and 3, the moisture vent 10 provides ventilation to exterior insulation and finishing systems 4 mounted in an air tight relationship with structures 8. To install the moisture vent 10 onto a structure 8 having the exterior insulation and finishing system 4 at or below grade, an installer should determine the height of the concrete foundation 6. Commonly, termite bonding companies prefer the exterior insulation and finishing system 4 to terminate at least eight inches above grade level. The installer should next cut the exterior insulation and finishing system 4 eight inches above grade level to form a bottom face 5. All exterior insulation and finishing system 4 material below the bottom face 5 is removed. Afterwards, the foam backing 2 should be separated from the foundation 6 approximately three inches above the bottom face 5. The moisture vent 10 is then "dry fitted" by inserting the back and front flashings 12 and 32 between the foundation 6 and the foam backing 2 until the stucco side 24 is adjacent the bottom face 5. As shown in FIG. 3, the moisture vent 10 is installed around corners by forming a mitered corner 50, wherein the mitered corner 50 is connected or bonded together by conventional means. After the moisture vent 10 has been "dry fitted" for the structure 8, a continuous bead of adhesive sealant or epoxy is applied to the exterior of the back flashing 12 proximate the intersection of the back flashing 12 and the base side 14 and pressed into place. Afterwards, a seal 52 is formed by placing a bead of sealant or caulking along the intersection of the exterior insulation and finishing system 4 and the stucco side 24. Obviously for new construction, the exterior insulation and finishing system 4 can be installed the appropriate distance above grade level, thereby eliminating the need to cut the exterior insulation and finishing system 4 by the installer. Otherwise, the installation steps remain the same.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A moisture vent, comprising:

an elongated back flashing for engaging a foundation of a structure;

an elongated base side extending outwardly from the back flashing and terminating at a lower edge;

an elongated vent side extending upwardly from the base side proximate the lower edge and terminating at an upper edge, the vent side having at least one vent;

an elongated stucco side extending inwardly from the vent side proximate the upper edge and terminating at a back edge, the stucco side having at least one slot;

a ventilation cavity defined by the back flashing and the base, vent and stucco sides;

a front flashing extending upwardly from the stucco side proximate the back edge juxtaposed in an air flow relationship with the back flashing and is engaged with a back side of an exterior insulation and finishing system;

a termite barrier of planar configuration extending outwardly and downwardly from the base side proximate the lower edge; and the back flashing and the base, vent and stucco sides define a peripheral edge and further comprise a cap for closing the ventilation cavity at the peripheral edge, the cap having an insert and a lip, the insert is engaged with the back flashing and the base, vent and stucco sides within the ventilation cavity and the lip are engaged with the peripheral edge.

2. A moisture vent as claimed in claim 1, wherein the at least one vent is a louvered vent.

3. A moisture vent as claimed in claim 1, wherein the at least one slot has a fin extending into the ventilation cavity.

4. A moisture vent, comprising:

an elongated back flashing for engaging a foundation of a structure;

an elongated front flashing juxtaposed in an air flow relationship with the back flashing and is engaged with a back side of an exterior insulation and finishing system;

an elongated stucco side extending outwardly from the front flashing and terminating at an upper edge, the stucco side having at least one slot;

an elongated vent side extending downwardly from the stucco side proximate the upper edge and terminating at a lower edge, the vent side having at least one vent, the lower edge being operatively connected to the back flashing;

a ventilation cavity defined by the back flashing and the vent and stucco sides;

a termite barrier of planar configuration extending outwardly and downwardly from the vent side proximate the lower edge;

a base side disposed between the back flashing and the vent side; and the back flashing and the vent and stucco sides define a peripheral edge and further comprise a cap for closing the ventilation cavity at the peripheral edge, the cap having an insert and a lip, the insert is engaged with the back flashing and the vent and stucco sides within the ventilation cavity and the lip are engaged with the peripheral edge.

5. A moisture vent as claimed in claim 4, wherein the at least one vent is a louvered vent.

6. A moisture vent as claimed in claim 4, wherein the at least one slot has a fin extending into the ventilation cavity.

* * * * *